US007079000B2

(12) United States Patent
Hamer et al.

(10) Patent No.: US 7,079,000 B2
(45) Date of Patent: Jul. 18, 2006

(54) SPOOL ASSEMBLY

(75) Inventors: Colin Hamer, El Paso, TX (US); James R Davis, El Paso, TX (US); Oscar Gamboa, Coahuila (MX)

(73) Assignee: Delphi Technologies, Inc., Troy, MI (US)

( * ) Notice: Subject to any disclaimer, the term of this patent is extended or adjusted under 35 U.S.C. 154(b) by 32 days.

(21) Appl. No.: 10/987,443

(22) Filed: Nov. 12, 2004

(65) Prior Publication Data

US 2006/0103498 A1 May 18, 2006

(51) Int. Cl.
*H01F 27/30* (2006.01)

(52) U.S. Cl. ..... 336/208; 336/198

(58) Field of Classification Search ..... 336/208, 336/198, 192

See application file for complete search history.

(56) References Cited

U.S. PATENT DOCUMENTS 5,632,136 A * 5/1997 Luchenbill et al. ..... 57/18
6,127,912 A * 10/2000 Dust et al. ..... 336/208
6,216,679 B1 * 4/2001 Skinner et al. ..... 123/635
6,353,378 B1 * 3/2002 Oosuka et al. ..... 336/96

* cited by examiner

*Primary Examiner*—Anh Mai
(74) *Attorney, Agent, or Firm*—Jimmy L. Funke

(57) ABSTRACT

A spool assembly retains a winding of an electrical wire thereabout. The electrical wire is covered by a liquid insulating material. The spool assembly includes a cylinder to finding a longitudinal axis and an outer diameter. The cylinder extends between a high voltage end and a low voltage end along the longitudinal axis. The spool assembly also includes a high retainer disposed about the cylinder at the high voltage end. The high retainer has a high retainer diameter greater than the outer diameter of the cylinder. The spool assembly also includes a low retainer disposed about the cylinder at the low voltage end. The low retainer has a low retainer diameter greater than the outer diameter of the cylinder. This spool assembly also includes a channel extending along the cylinder inwardly from the outer diameter to receive the liquid insulating material when the liquid insulating material is forced through the winding to prevent air voids from forming at the inside diameter of the winding.

4 Claims, 2 Drawing Sheets

SPOOL ASSEMBLY

BACKGROUND ART

1. Field of the Invention

The invention relates to a spool assembly designed to have a wire encapsulated thereabout. More particularly, the invention relates to a spool assembly having a flow channel allowing for the efficient replacement of air with an insulating material into the wire wound thereabout.

2. Description of the Related Art

Transformers, such as ignition coils, have primary and secondary windings of electrical wire wound about a spool. In the case of an ignition coil, the secondary coil is a high voltage coil and must contain no air. Air is removed from the secondary coil by forcing an insulating material into the secondary winding. A current method of forcing the insulating material into the winding is the casting of liquid into the winding after first lowering the encapsulation chamber atmosphere to around 1 mBar. The most efficient impregnation techniques using the above-mentioned method will yield a residual air volume of approximately 0.1%, depending upon the ambient air pressure. In the current designs, the only direction that the liquid insulator can flow into the secondary winding is through the very fine and tightly wound wire. One of the effects of having the liquid insulator travel through the secondary winding is that small pockets of residual air will have a tendency to be located on the interface between the spool and the inside diameter of the winding (typically in the thickest sections of the wound wire).

Referring to FIG. 1, a cross section of a prior art spool assembly is generally indicated at 10. A spool assembly 10 includes a cylinder 12 having an electrical winding 14 wound about the cylinder 12 of the spool assembly 10. An air void 16 can exist between the electrical winding 14 and the cylinder 12 where the electrical winding 14 is the thickest. The air void 16 reduces the reliability of the spool assembly 10.

SUMMARY OF THE INVENTION

A spool assembly retains a winding of an electrical wire thereabout. The electrical wire is covered by a liquid insulating material. The spool assembly includes a cylinder defining a longitudinal axis and an outer diameter. The cylinder extends between a high voltage end and a low voltage end along the longitudinal axis. The spool assembly also includes a high retainer disposed about the cylinder at the high voltage end. The high retainer has a high retainer diameter greater than the outer diameter of the cylinder. The spool assembly also includes a low retainer disposed about the cylinder at the low voltage end. The low retainer has a low retainer diameter greater than the outer diameter of the cylinder. This spool assembly also includes a channel extending along the cylinder inwardly from the outer diameter to receive the liquid insulating material when the liquid insulating material is forced through the winding to prevent air voids from forming inside the winding.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 2:
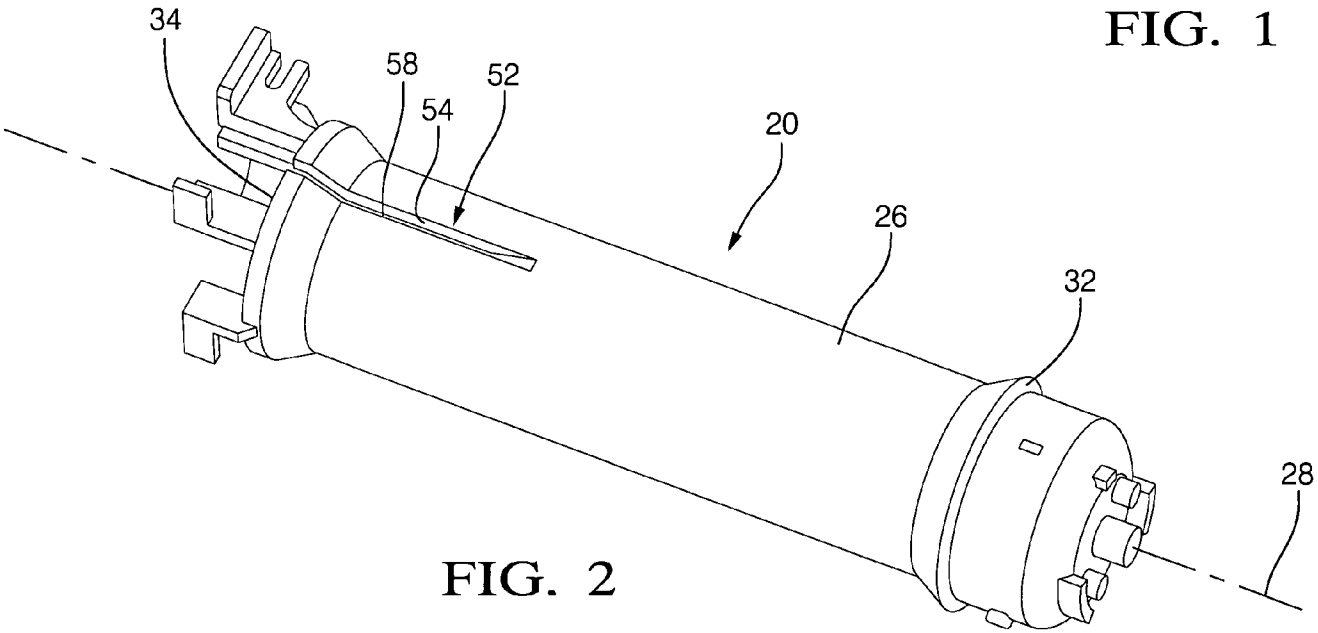
FIG. 2 is a perspective view of one embodiment of the invention.
Figure 3:
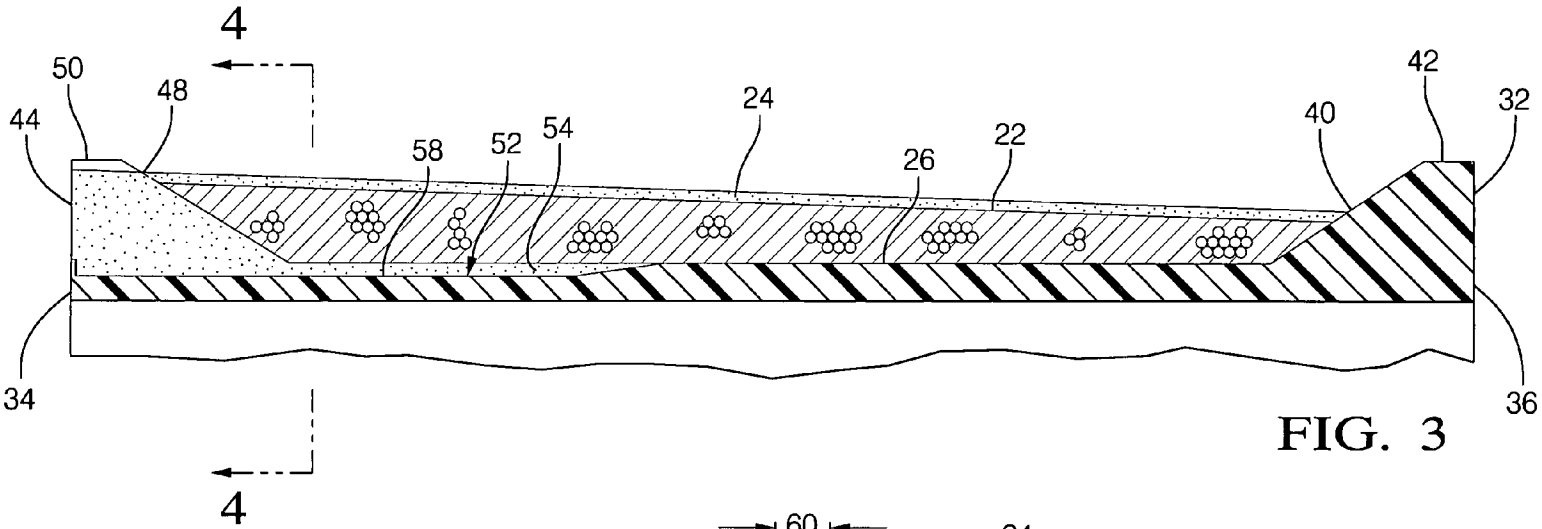
FIG. 3 is a cutaway cross-sectional view of the invention.
Figure 4:
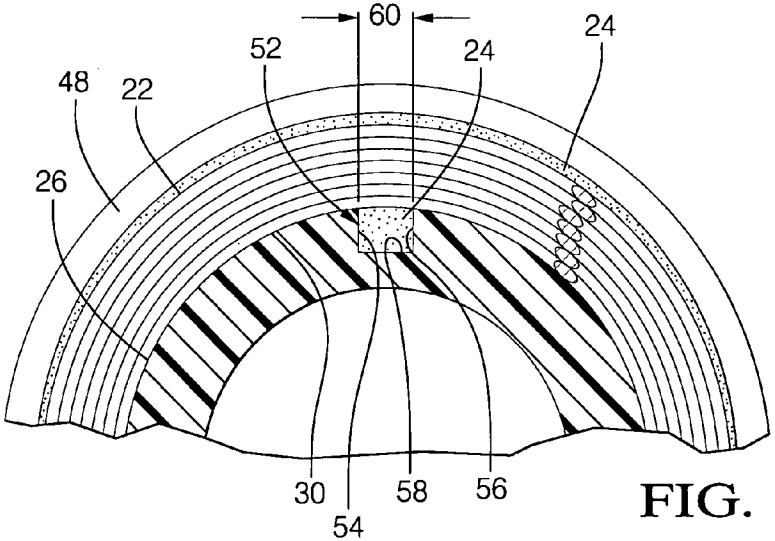
FIG. 4 is a cut away cross-sectional view taken along lines 4—4 of FIG. 2.

Referring to FIG. 2, a spool assembly is generally indicated at 20. The spool assembly 20 is for retaining a winding of electrical wire 22 (best shown in FIG. 3) thereabout. The spool assembly is designed to receive a liquid insulating material 24 that coats the winding of electrical wire 22 such that there is no air intermixed with the winding of electrical wire 22.

The spool assembly 20 includes a cylinder 26. The outer surface of cylinder 26 defines a main winding surface. The cylinder 26 defines a longitudinal axis 28 and an outer diameter 30. The cylinder 26 extends between a high voltage end 32 and a low voltage end 34.

A high retainer 36 is disposed about the cylinder 26 at the high voltage end 32. The high retainer 36 has a high retainer diameter 38 that is greater than the outer diameter 30 of the cylinder 26. The high retainer 36 includes a first angled surface 40. The first angled surface 40 extends between the cylinder 26 and a high outer surface 42.

Likewise, a low retainer 44 is disposed about the low voltage end 34. The low retainer 44 has a low retainer diameter 46 that is greater than the outer diameter 30 of the cylinder 26. The low retainer 44 includes a second angled surface 48 that extends between the cylinder 26 and a low outer surface 50. The low retainer 44 and the high retainer 36 are used to retain the winding of electrical wire 22 therebetween. The first 40 and second 48 angled surfaces help retain the liquid insulating material 24 therein until the liquid insulating material 24 cures into a solid mass.

The spool assembly 20 also includes a low retainer channel 53. The low retainer channel 53 is coaxial with the channel 52. The low retainer channel 53 extends the channel 52 through the low retainer 44. Therefore, the sides 55 of the low retainer channel 53 extend higher than the channel 52 because the low retainer channel 53 cuts through an entire radius of the low retainer 44.

The spool assembly 20 also includes a channel, generally shown at 52. The channel 52 includes first 54 and second 56 channel sides. In the embodiment shown in FIGS. 2 and 3 the channel 52 also includes a bottom surface 58. It should be appreciated by those skilled in the art that the bottom surface 58 may not exist should the channel 52 extend all the way through the cylinder 26.

The first 54 and second 56 channel sides are separated by a distance 60. More specifically, the distance 60 is related to the thickness of the electrical wire used to create the winding 22 as well as the radius of the cylinder 26. The distance 60 is designed such that the winding of electrical wire 22 is wound about the cylinder 26 and there is no change in the path of the winding of electrical wire 22 due to the existence of the channel 52. Therefore, there is no dip in the winding of electrical wire 22 over the channel 52.

Figure 1:
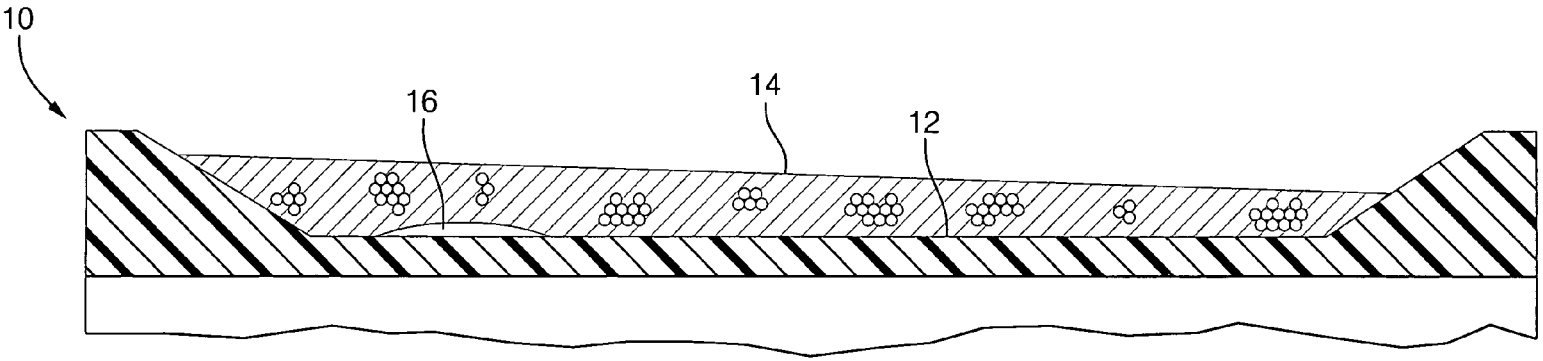
PRIOR ART FIG. 1
FIG. 1 is a cutaway cross-sectional view of a prior art spool assembly.

The channel 52 extends along a portion of the main winding surface coaxial with the longitudinal axis 28. The channel 52 receives the liquid insulating material 24 when the liquid insulating material 24 is forced through the winding of electrical wire 22. This assures that all of the air that may exist within the winding of electrical wire 22 has an opportunity to be forced out through the channel 52 and exit the winding of electrical wire 22. Therefore, air voids such as the air void 16 shown in FIG. 1 are not present in the spool assembly 20 according to the invention.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

What is claimed is:

1. A spool assembly for retaining a winding of an electrical wire thereabout that is covered by a liquid insulating material, said spool assembly comprising:

a cylinder defining a longitudinal axis, an outer diameter, and a winding surface, said cylinder extending between a high voltage end and a low voltage end along said longitudinal axis;

a high retainer disposed about said cylinder at said high voltage end, said high retainer having a high retainer diameter greater than said outer diameter of said cylinder;

a low retainer disposed about said cylinder at said low voltage end, said low retainer having a low retainer diameter greater than said outer diameter of said cylinder; and a channel extending along said winding surface inwardly from said outer diameter to receive the liquid insulating material when the liquid insulating material is forced through the winding of electrical wire to prevent air voids from forming inside the winding.

2. A spool assembly as set forth in claim 1 wherein said channel includes a low retainer channel extending through said low retainer.

3. A spool assembly as set forth in claim 2 wherein said channel defines a distance that is small such that the winding of electrical wire is prevented from entering said channel.

4. A spool assembly for retaining a winding of an electrical wire thereabout that is covered by a liquid insulating material, said spool assembly comprising:

a cylinder defining a longitudinal axis, an outer diameter, and a winding surface, said cylinder extending between a high voltage end and a low voltage end along said longitudinal axis;

a high retainer disposed about said cylinder at said high voltage end, said high retainer having a high retainer diameter greater than said outer diameter of said cylinder;

a low retainer disposed about said cylinder at said low voltage end, said low retainer having a low retainer diameter greater than said outer diameter of said cylinder;

a channel extending along said winding surface inwardly from said outer diameter to receive the liquid insulating material when the liquid insulating material is forced through the winding to prevent air voids from forming inside the winding, said channel defining a distance that is small such that the winding of electrical wire prevented from entering said channel.

* * * * *